US007979010B2

(12) United States Patent
Fuwa et al.

(10) Patent No.: US 7,979,010 B2
(45) Date of Patent: Jul. 12, 2011

(54) IMAGE FORMING APPARATUS AND IMAGE FORMING METHOD

(75) Inventors: Kazuoki Fuwa, Kawanishi (JP); Yoshihiro Mikuriya, Nishinomiya (JP); Hideaki Yasunaga, Ibaraki (JP); Yoshitaka Sekiguchi, Nishinomiya (JP); Hiroaki Kato, Nagaokakyo (JP)

(73) Assignee: Ricoh Company, Ltd., Tokyo (JP)

( * ) Notice: Subject to any disclaimer, the term of this patent is extended or adjusted under 35 U.S.C. 154(b) by 231 days.

(21) Appl. No.: 12/342,656

(22) Filed: Dec. 23, 2008

(65) Prior Publication Data

US 2009/0169270 A1 Jul. 2, 2009

(30) Foreign Application Priority Data

Dec. 27, 2007 (JP) ..... 2007-337251

(51) Int. Cl.
*G03G 15/08* (2006.01)
*G03G 9/00* (2006.01)

(52) U.S. Cl. ..... 399/258; 430/105

(58) Field of Classification Search ..... 399/279, 399/281, 286, 258, 252; 430/105, 106.1, 430/108.1, 110.4
See application file for complete search history.

(56) References Cited

U.S. PATENT DOCUMENTS 5,508,788 A * 4/1996 Watanabe et al. ..... 399/175
2005/0220499 A1* 10/2005 Kawahara et al. ..... 399/281
2006/0204882 A1 9/2006 Nozaki et al.
2006/0210902 A1 9/2006 Nakamura et al.
2006/0275686 A1 12/2006 Kadota et al.
2006/0292474 A1 12/2006 Mikuriya et al.
2007/0026335 A1 2/2007 Yamamoto et al.
2007/0059625 A1 3/2007 Yamamoto et al.
2007/0122729 A1 5/2007 Katoh et al.
2007/0148568 A1 6/2007 Kadota et al.
2007/0190443 A1 8/2007 Hagi et al.
2007/0207399 A1 9/2007 Kadota et al.
2007/0212630 A1 9/2007 Yasunaga et al.
(Continued)

FOREIGN PATENT DOCUMENTS

JP 2000-147898 5/2000
(Continued)

OTHER PUBLICATIONS

U.S. Appl. No. 12/197,651, filed Aug. 25, 2008, Katoh, et al.

*Primary Examiner* — David M Gray
*Assistant Examiner* — Billy J Lactaoen
(74) *Attorney, Agent, or Firm* — Oblon, Spivak, McClelland, Maier & Neustadt, L.L.P.

(57) ABSTRACT

Provided is an image forming apparatus including at least a latent image bearing member, a latent electrostatic image forming unit, a developing unit which includes at least a developing roller and a supply roller, and a transfer unit, wherein both of a diameter R (mm) of the developing roller and a diameter R' (mm) of the supply roller are 12 mm or less; the toner contains at least a binder resin, a wax, and a colorant with the wax having a melting point of 75° C. or less; an amount of the wax exposed on a surface of the toner is 10 mg/g to 30 mg/g; and when a diameter (mm) of the developing roller is represented by R the toner has a torque T (mNm) satisfying the inequation, $20/R<T<27/R$, at a void rate of 58% as measured by a torque measurement method using a conical rotor.

12 Claims, 4 Drawing Sheets

U.S. PATENT DOCUMENTS

| | | | | |
|---|---|---|---|---|
| 2007/0217842 | A1 | 9/2007 | Kato et al. | |
| 2007/0238042 | A1 | 10/2007 | Yasunaga et al. | |
| 2008/0038656 | A1 | 2/2008 | Yasunaga et al. | |
| 2008/0063957 | A1 | 3/2008 | Murakami et al. | |
| 2008/0069605 | A1 | 3/2008 | Fuwa et al. | |
| 2008/0069608 | A1 | 3/2008 | Katoh et al. | |
| 2008/0070149 | A1* | 3/2008 | Kato et al. | 430/111.4 |
| 2008/0101823 | A1 | 5/2008 | Katoh et al. | |
| 2008/0145109 | A1* | 6/2008 | Murayama et al. | 399/260 |
| 2008/0153018 | A1 | 6/2008 | Mikuriya et al. | |
| 2008/0159777 | A1 | 7/2008 | Fuwa et al. | |
| 2008/0175630 | A1 | 7/2008 | Yasunaga et al. | |
| 2008/0199234 | A1 | 8/2008 | Hagi et al. | |
| 2008/0226356 | A1 | 9/2008 | Yasunaga et al. | |
| 2008/0227009 | A1 | 9/2008 | Fuwa et al. | |
| 2008/0233506 | A1 | 9/2008 | Hagi et al. | |

FOREIGN PATENT DOCUMENTS

| | | |
|---|---|---|
| JP | 2003-43725 | 2/2003 |
| JP | 2004-258053 | 9/2004 |
| JP | 3919541 | 2/2007 |

* cited by examiner

IMAGE FORMING APPARATUS AND IMAGE FORMING METHOD

BACKGROUND OF THE INVENTION

1. Field of the Invention

The present invention relates to an image forming apparatus and an image forming method which are capable of satisfying both excellent fixing property and excellent adhesion resistance even when using a developing roller and a supply roller each having a diameter as small as 12 mm or less.

2. Description of the Related Art

Dry development systems employed in electrophotography are of two types: a development system using a two-component developer composed of toner and carrier; and a development system using a one-component developer containing no carrier. In recent years, with increased demands for cost reduction and downsizing of low-end laser printers, attention has been focused on the latter development system using a one-component developer. In a development device using a one-component developer, such a process is widely employed that a thin-layer forming member is disposed facing a developing roller, a toner conveyed on a surface of the developing roller is pressed by the thin-layer forming member so that the thickness of a toner layer is controlled, and the toner is charged while passing between the thin-layer forming member and the developing roller.

In the above process, however, the thin layer forming member generates heat by friction caused between the thin layer forming member and the developing roller. To achieve further downsized image forming apparatus, it is effective to make developing rollers and supply rollers have smaller diameters. However, in association with downsizing of developing rollers and supply rollers, heat generated by the thin-layer forming member increases and some of a toner adheres to the developing roller.

For preventing the toner adhesion caused by frictional heat between the developing roller and the thin-layer forming member and preventing occurrence of streaks on printed recording media, for example, Japanese Patent No. 3,919,541 proposes an image forming method of using a process cartridge which includes at least a latent image bearing member having a diameter of 33 mm or less, a developer container, a toner bearing member having a diameter of 20 mm or less placed in contact with the latent image bearing member, a supply roller placed in contact with the toner bearing member, and a toner conveyance unit configured to convey toner to the supply roller, in which a ratio of the revolution speed of the toner conveyance unit to that of the supply roller is 0.1 to 0.5, and the amount of a toner coat (A) on the toner bearing member and the filling rate of toner (B) in the developer container satisfy an inequation, $0.9B \leqq A \leqq 3B$, and in the process cartridge, a one-component toner is used which contains at least a binder resin, a colorant, and a wax and which has a methanol wettability half value of 30% to 80%.

However, since a methanol wettability half value varies depending not only on an exposed wax on the toner surface but also on the type and the amount of external additives, it is difficult to improve fixing property and to eliminate problems with the thin-layer forming member by simply adjusting the methanol wettability half value.

Thus, at present desired are an image forming apparatus and an image forming method which are capable of satisfying both excellent fixing property and excellent adhesion resistance and of forming high-quality images, even when using a developing roller and a supply roller each having a diameter as small as 12 mm or less.

BRIEF SUMMARY OF THE INVENTION

An object of the present invention is to provide an image forming apparatus and an image forming method which are capable of satisfying excellent fixing property and excellent adhesion resistance and of forming high-quality images, even when using a developing roller and a supply roller each having a diameter as small as 12 mm or less.

The above mentioned problems are solved by the following means:

<1> An image forming apparatus including at least a latent image bearing member, a latent electrostatic image forming unit configured to form a latent electrostatic image on the latent image bearing member, a developing unit which includes at least a developing roller for supplying a toner to the latent electrostatic image and a supply roller for supplying the toner to the developing roller and is configured to develop the latent electrostatic image to form an visible image, and a transfer unit configured to transfer the visible image onto a recording medium, wherein both of a diameter R (mm) of the developing roller and a diameter R' (mm) of the supply roller are 12 mm or less, wherein the toner contains at least a binder resin, a wax, and a colorant with the wax having a melting point of 75° C. or less; an amount of the wax exposed on a surface of the toner is 10 mg/g to 30 mg/g; and when a diameter (mm) of the developing roller is represented by R the toner has a torque T (mNm) satisfying the inequation, $20/R<T<27/R$, at a void rate of 58% as measured by a torque measurement method using a conical rotor.

<2> The image forming apparatus according to the item <1>, wherein the developing roller has a surface roughness (Ra) of 1.1 μm to 1.8 μm.

<3> The image forming apparatus according to the item <1>, wherein the supply roller has foamed cells on the surface thereof and the cells have an average diameter of 300 μm to 500 μm.

<4> The image forming apparatus according to the item <1>, wherein the toner contains the wax in an amount of 2.5% by mass to 6.0% by mass.

<5> The image forming apparatus according to the item <1>, wherein the toner has a volume average particle diameter of 6 μm to 10 μm.

<6> The image forming apparatus according to the item <1>, wherein the toner has a softening point (Tm) of 110° C. to 140° C.

<7> An image forming method including at least forming a latent electrostatic image on a latent image bearing member, developing the latent electrostatic image by means of a developing unit which includes at least a developing roller for supplying a toner to the latent electrostatic image and a supply roller for supplying the toner to the developing roller, to form a visible image, and transferring the visible image onto a recording medium, wherein both of a diameter R (mm) of the developing roller and a diameter R' (mm) of the supply roller are 12 mm or less, wherein the toner contains at least a binder resin, a wax, and a colorant with the wax having a melting point of 75° C. or less; an amount of the wax exposed on a surface of the toner is 10 mg/g to 30 mg/g; and when a diameter (mm) of the developing roller is represented by R the toner has a torque T (mNm) satisfying the inequation, $20/R<T<27/R$, at a void rate of 58% as measured by a torque measurement method using a conical rotor.

According to the present invention, it is possible to solve problems of the prior art, and to provide an image forming apparatus and an image forming method which can satisfy both excellent fixing property and excellent adhesion resistance and can produce high-quality images, even when using a developing roller and a supply roller each having a diameter as small as 12 mm or less.

Figure 1:
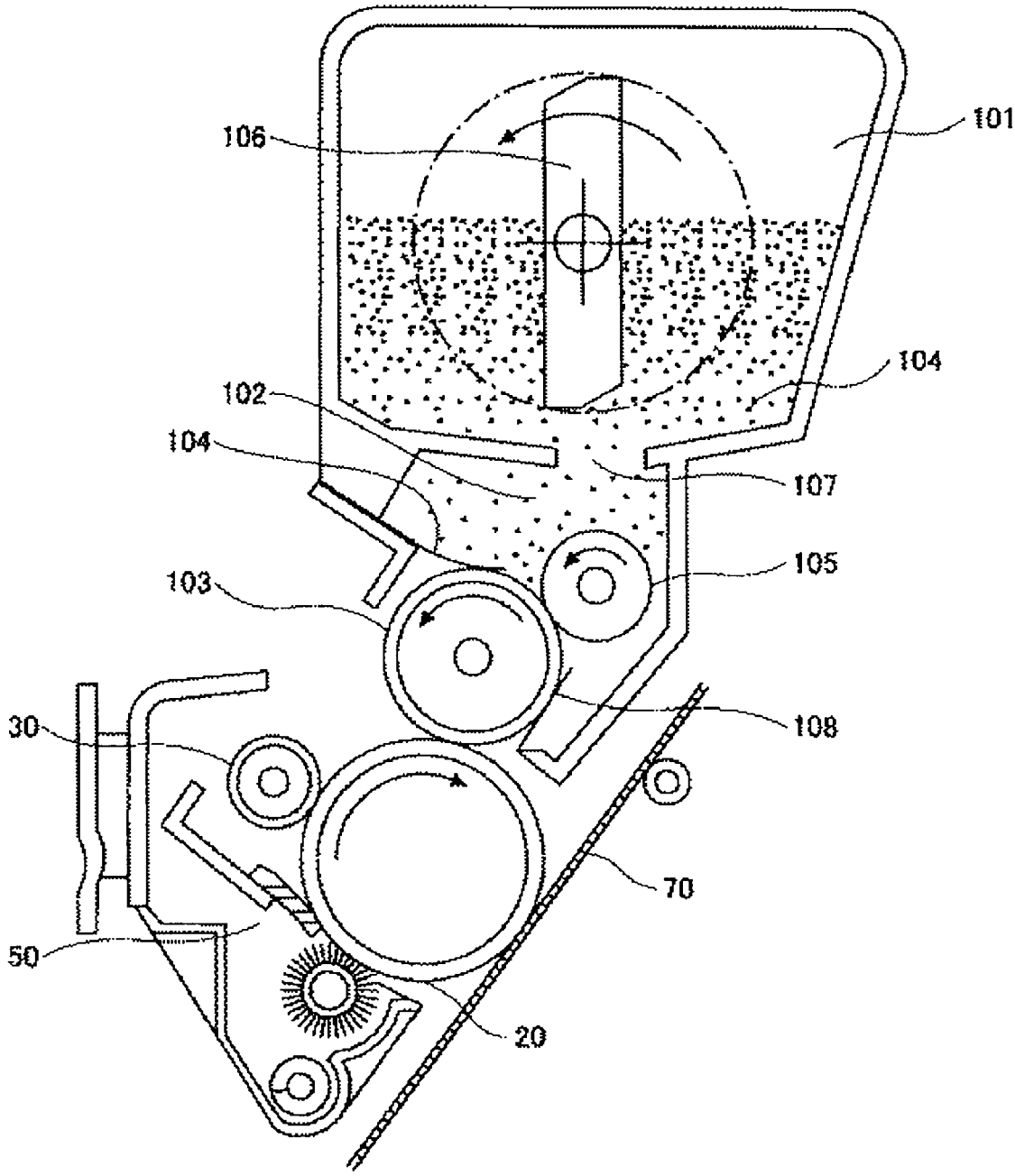
FIG. 1 is a sectional view showing an example of a developing unit and a process cartridge in an image forming apparatus of the present invention.

DETAILED DESCRIPTION OF THE INVENTION (Image Forming Apparatus and Image Forming Method)

An image forming apparatus according to the present invention includes at least a latent image bearing member, a latent electrostatic image forming unit, a developing unit, and a transfer unit, and further includes additional unit(s) appropriately selected as required such as a fixing unit, a charge eliminating unit, a cleaning unit, a recycling unit, and a controlling unit.

An image forming method according to the present invention includes at least a latent electrostatic image forming step, a developing step, and a transferring step, and further includes additional step(s) appropriately selected as required such as a fixing step, a charge eliminating step, a cleaning step, a recycling step, and a controlling step.

The image forming method of the present invention may be appropriately carried out using the image forming apparatus of the present invention, the latent electrostatic image forming step may be carried out using the latent electrostatic image forming unit, the developing step may be carried out using the developing unit, the transferring step may be carried out using the transfer unit, and the additional step(s) may be carried out using the additional unit(s).

—Latent Electrostatic Image Forming Step and Latent Electrostatic Image Forming Unit—

The latent electrostatic image forming is a step of forming a latent electrostatic image on a latent electrostatic image bearing member.

The material, shape, structure, size, etc. of the latent image bearing member (may be referred to as "latent electrostatic image bearing member", "electrophotographic photoconductor", and "photoconductor") are not specifically limited and can be appropriately selected from those known in the art. The latent image bearing member is preferably drum-shaped, and is, for example, an inorganic photoconductor made of amorphous silicon, selenium or the like, or an organic photoconductor made of polysilane, phthalopolymethine, or the like. Among these, amorphous silicon is preferred in terms of achieving long life.

For the amorphous silicon photoconductor, for example, it is possible to use a photoconductor having a photoconductive layer composed of a-Si (hereinafter, may be referred to as "a-Si photoconductor") which is produced by heating a support at 50° C. to 400° C. and depositing a-Si on the support according to a film forming method such as vacuum deposition, sputtering, ion plating, heat CVD, photo CVD, or plasma CVD. Among these, preferred is a photoconductor produced by a plasma CVD method in which a raw material gas is decomposed by direct current glow discharge or high-frequency wave or microwave glow discharge and an a-Si deposited film is formed on the support.

The latent electrostatic image formation may be carried out, for example, by imagewise exposure of a surface of the latent image bearing member right after uniformly charging the entire surface of the latent image bearing member, and may be carried out by the latent electrostatic image forming unit.

The latent electrostatic image forming unit includes at least a charging unit configured to uniformly charge the surface of the latent image bearing member, and an exposure unit configured to imagewisely expose the surface of the latent image bearing member.

The charging may be carried out, for example, by applying voltage to the surface of the latent image bearing member by means of the charging unit.

The charging unit is not particularly limited and can be appropriately selected depending on the intended purpose. Examples of the charging unit include the known contact-charging units equipped with a conductive or semiconductive roller, blush, film or rubber blade, etc., and non-contact-charging units utilizing corona discharge such as a corotron or a scorotoron, etc.

In addition to the shape of roller, the charging device may take any shape including magnetic brush and fur brush, etc., and may be selected in accordance with the specifications and the form of the electrophotographic device. For example, the magnetic brush as a charging part is composed of a charging member made of various ferrite particles such as Zn—Cu ferrite, a non-magnetic conductive sleeve for supporting the charging member, and a magnetic roll incorporated in the non-magnetic conductive sleeve. Furthermore, the fur brush as a charging member may be a fur conductively treated with carbon, copper sulfide, metal or metal oxide, and the fur is wound around a metal or attached to a conductively treated cored bar so as to be used as a charger.

The charging unit is not limited to the contact-charging unit as described above, however, the contact-charging is preferably used, because thereby an image forming apparatus with reduced amount of ozone emission from the charging unit is obtained.

The exposure may be carried out, for example, by imagewise exposure of the surface of the latent image bearing member by means of the exposure unit.

The exposure unit is not particularly limited as long as predetermined imagewise exposure is possible on the surface of the latent image bearing member that has been charged by the charging unit, and can be appropriately selected depending on the intended purpose. Examples of the exposure unit are various exposure units such as an optical copy unit, a rod-lens-array unit, an optical laser unit, an optical liquid crystal shatter unit, and the like In the present invention, a backlight system may be applied for the exposure, in which imagewise-exposure is carried out from the back side of the latent image bearing member.

—Developing Unit and Developing Step—

The developing step is a step of forming a visible image by developing a latent electrostatic image with a toner or developer using the developing unit.

The developing unit is composed of at least a developing roller for developing the latent electrostatic image with supply of a toner, and a supply roller for supplying the developing roller with the toner, and further composed of additional members as required.

Both of a diameter R (mm) of the developing roller and a diameter R' (mm) of the supply roller are 12 mm or less, preferably 11 mm or less, and more preferably 6 mm to 11 mm. When the roller diameters R and R' are more than 12 mm, the material cost for the image forming apparatus becomes high or it becomes difficult to downsize the image forming apparatus.

The surface roughness (Ra) of the developing roller is preferably 1.1 μm to 1.8 μm. When the surface roughness is 1.1 μm or more, occurrence of toner adhesion due to reduced amount of conveyed toner may be suppressed. Meanwhile, when the surface roughness (Ra) is 1.8 μm or less, occurrence of fogging or minute indentations of an image contour may be suppressed.

The surface roughness (Ra) of the developing roller may be measured by, for example, a stylus roughness meter.

The surface of the supply roller is coated with a foamed material. An average diameter of foamed cells of the supply roller is 300 μm to 500 μm, and more preferably 350 μm to 450 μm. When the average cell diameter of the supply roller is 300 μm or more, occurrence of toner adhesion due to excessively small amount of toner supplied to the developing roller may be suppressed. Meanwhile, when the average cell diameter is 500 μm or less, fogging due to excessively large amount of toner supplied to the developing roller becomes less likely to occur.

The toner contains at least a binder resin, a wax, and a colorant. The wax has a melting point of 75° C. or less, and preferably a melting point of 65° C. to 75° C. When the melting point of wax is 75° C. or less, wax becomes easy to melt at the time of fixing, and exudation from the toner becomes sufficient, resulting in favorable releasing property from the fixing roller.

The toner has an amount of wax exposed on a surface of 10 mg/g to 30 mg/g, and preferably of 15 mg/g to 20 mg/g. When the amount of exposed wax on a surface of the toner is 10 mg/g or more, exudation amount of wax in fixation becomes sufficient, making it possible to obtain excellent releasing property to the fixing roller. When the amount of wax exposed on the surface of the toner is 30 mg/g or less, the amount of the toner surface exposed becomes appropriate, resulting in no occurrence of filming on the photoconductor.

Here, the amount of wax exposed on a surface of the toner can be determined by measuring off 1.0 g of toner base particles before addition of an inorganic fine particle, adding 7 ml of n-hexane thereto, stirring the mixture by a roll mill at 120 rpm for one min, subjecting the solution to suction filtration, removing n-hexane by vacuum drying, and quantifying the mass (mg) of the components remained, which corresponds to the amount of exposed wax on the surface of the toner.

The torque T (mNm) of the toner at a void rate of 58% as measured by a torque measurement method using a conical rotor, satisfies an inequation, $20/R<T<27/R$, and preferably an inequation, $22/R<T<24/R$, where R represents a diameter (mm) of the developing roller.

When the torque T is larger than 20/R, friction between the first layer of the toner on the developing roller and the second or subsequent layers of the toner becomes appropriate, and the heat capacity is increased by an increase in the amount of toner passing the toner layer thickness regulating unit, resulting in no occurrence of toner adhesion even when the toner layer thickness regulating unit generates heat. Meanwhile, when the torque T is smaller than 27/R, friction between the toner does not become excessively large, resulting in no occurrence of fogging due to reduction in charging amount.

—Toner—

The toner which can be used in the present invention contains at least a binder resin, a wax, and a colorant, and contains a charge controlling agent, an external additive, further additional components as required.

—Binder Resin—

The binder resin is not particularly limited, and may be appropriately selected depending on the purpose; examples thereof include the binder resins known in the full color toner field such as polyester resins, (meth)acrylic resins, styrene-(meth)acryl copolymer resins, epoxy resins, and COC (cyclic olefin resins, for example, TOPAS-COC manufactured by Ticona). It is particularly preferable to use the polyester resin in terms of stress resistance in the developing unit.

The polyester resin which is obtained through polycondensation of a polyvalent alcohol component and a polyvalent carboxylic acid component may be preferably used.

Examples of bivalent alcohol components as the polyvalent alcohol component include bisphenol A-alkylene oxide adducts such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane; ethylene glycol, diethylene glycol, triethylene glycol, 1,2-propylene glycol, 1,3-propylene glycol, 1,4-butandiol, neopentyl glycol, 1,4-butendiol, 1,5-pentanediol, 1,6-hexanediol, 1,4-cyclohexanedimethanol, dipropylene glycol, polyethylene glycol, polytetramethylene glycol, bisphenol A, and hydrogenated bisphenol A.

Examples of trivalent or more alcohol components include sorbitol, 1,2,3,6-hexanetetrol, 1,4-sorbitan, pentaerythritol, dipentaerythritol, tripentaerythritol, 1,2,4-butantriol, 1,2,5-pentantriol, glycerol, 2-methylpropanetriol, 2-methyl-1,2,4-butantriol, trimethyrolethane, trimethyrolpropane, and 1,3,5-trihydroxymethylbenzene.

Furthermore, examples of bivalent carboxylic acid components of polyvalent carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid and anhydrides thereof or lower alkylester thereof.

Examples of trivalent or more carboxylic acid components include 1,2,4-benzenetricarboxylic acid (trimellitic acid), 1,2,5-benzentricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, enpol trimeric acid, and anhydrides thereof or lower alkylester thereof.

Furthermore, a resin obtained by performing condensation polymerization for obtaining polyester resin and radical polymerization for obtaining vinyl resin simultaneously in a same container using a mixture of a basic monomer of polyester resin, basic monomer of vinyl resin and a monomer which reacts with the basic monomers of both resins may be also preferably used as the polyester resin (hereinafter, may be referred to as "vinyl-based polyester resin"). Meanwhile, a monomer which reacts with basic monomers of both resins is defined as a monomer which can be used for both reactions of condensation polymerization and radical polymerization. In other words, it is a monomer having a carboxyl group which is reactable in condensation polymerization and a vinyl group which is reactable in radical polymerization and examples of such monomer include fumaric acid, maleic acid, acrylic acid and methacrylic acid.

Examples of the basic monomers of the polyester resin include the above-described polyvalent alcohol components and polyvalent carboxylic components. Examples of the basic monomers of the vinyl based resin include styrene or styrene derivatives such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene-based unsaturated monoolefins such as ethylene, propylene, butylene and isobutylene; methacrylate alkyl esters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl) butyl methacrylate, hexyl methacrylate, octyl methacrylate, nonyl methacrylate, decyl methacrylate, undecyl methacrylate, and dodecyl methacrylate; acrylate alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid and maleic acid; acrylonitrile, maleate ester, itaconate ester, vinyl chloride, vinyl acetate, vinyl benzoate, vinyl methyl ethyl ketone, vinyl hexyl ketone, vinyl methyl ether, vinyl ethyl ether and vinyl isobutyl ether.

Examples of the polymerization initiators when the basic monomer of the vinyl based resin is polymerized include azo based or diazo based polymerization initiators such as 2,2'-azobis(2,4-dimethylvaleronitrile), 2,2'-azobisisobutylonitrile, 1,1-azobis(cyclohexane-1-carbonitrile) and 2,2'-azobis-4-methoxy-2,4-dimethylvaleronitrile; and peroxide based polymerization initiators such as benzoyl peroxide, dicumyl peroxide, methyl ethyl ketone peroxide, isopropyl peroxycarbonate, and lauroyl peroxide.

As the binder resin, the above-described various polyester based resins are preferably used. Of these, it is effective and more preferable to combine a first binder resin and a second binder resin as described hereinafter, in terms of enhancing the separation property and the offset resistance as the toner for oilless fixing.

That is, as the first binder resin, the polyester resins obtained by polycondensing the above-described polyvalent alcohol component and polyvalent carboxylic acid component, particularly, the polyester resins obtained by using a bisphenol A alkylene oxide adduct as the polyvalent alcohol component and using terephthalic acid and fumaric acid as the polyvalent carboxylic acids are used.

As the second binder resin, the vinyl-based polyester resins, particularly the vinyl-based polyester resins obtained by using a bisphenol A alkylene oxide adduct, terephthalic acid, trimellitic acid and succinic acid as the basic monomers of the polyester resin, using styrene and butyl acrylate as the basic monomers of the vinyl based resin and using fumaric acid as the monomer which reacts with the both are used.

In the present invention, a hydrocarbon-based wax is preferably internally added upon synthesis of the first binder resin. To previously internally add the hydrocarbon-based wax to the first binder resin, the first binder resin may be synthesized with adding the hydrocarbon-based wax in the monomers for synthesizing the first binder resin. For example, the polycondensation may be performed in a state that the hydrocarbon-based wax has been added to an acid monomer or alcohol monomer which composes the polyester-based resin as the first binder resin. When the first binder resin is a vinyl-based polyester resin, a hydrocarbon-based wax is first added to a basic monomer for polyester resin, and then polycondensation and radical polymerization may be performed by adding dropwise a basic monomer for the vinyl-based resin to the monomer while stirring and heating the monomers.

—Wax—

Generally, a wax having a lower polarity is more excellent in the releasing property from the fixing member (roller). Therefore, as the wax used in the present invention a hydrocarbon-based wax having a low polarity is preferably used. The hydrocarbon-based wax is the wax composed of only carbon atoms and hydrogen atoms, and the wax not containing ester, alcohol and amide groups.

The hydrocarbon-based waxes are not particularly limited, and may be appropriately selected depending on the purpose; examples thereof include polyolefin waxes such as polyethylene, polypropylene and copolymers of propylene with ethylene; petroleum waxes such as paraffin wax and microcrystalline wax; and synthetic waxes such as Fisher Tropsch wax. Of these, the polyethylene wax, the paraffin wax, and the Fisher Tropsch wax are preferred, and the polyethylene wax and the paraffin wax are particularly preferred.

The amount of the wax in the toner is preferably 2.5% by mass to 6.0% by mass. When the amount of the wax is 2.5% by mass or more, the exudation amount of the wax in fixation is appropriate, making it possible to obtain excellent releasing property to the fixing roller. Meanwhile, when the amount of the wax is 6.0% by mass or less, filming on the photoconductor becomes less likely to occur.

The toner according to the present invention may contain a wax dispersant for aiding dispersion of wax.

The wax dispersant is not particularly limited, and for the wax dispersant a known wax dispersant may be used; examples of the wax dispersant include polymers or oligomers which contains blocks composed of a unit with high compatibility to the wax or a unit with high compatibility to a resin, polymers or oligomers in which a unit with high compatibility to the wax or a unit with high compatibility to the resin is grafted to the other unit, copolymers of an unsaturated hydrocarbon such as ethylene, propylene, butane, styrene, and α-styrene and an α,β-unsaturated carboxylic acid such as acrylic acid, methacrylic acid, maleic acid, maleic acid anhydrate, itaconic acid, and itaconic acid anhydrate or an ester or an anhydrate thereof, block copolymers or graft copolymers of vinyl based resin and polyester.

Examples of a unit with high compatibility to the wax include a long-chain alkyl group having 12 or more carbon atoms, or polyethylene, polypropylene, polybutene, or polybutadiene or copolymers thereof; and examples of a unit with high compatibility to the resin include a polyester or vinyl based resin.

—Colorant—

The colorant is not particularly limited, and as the colorant the known pigments and dyes conventionally used as the colorants for full color toners can be used. Examples thereof include carbon black, aniline blue, calcoil blue, chromium yellow, ultramarine blue, DuPont oil red, quinoline yellow, methylene blue chloride, copper phthalocyanine, malachite green oxalate, lamp black, rose Bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. pigment yellow 74, C.I. solvent yellow 162, C.I. pigment yellow 180, C.I. pigment yellow 185, C.I. pigment blue 15:1 and C.I. pigment blue 15:3. These may be used alone or in combination of two or more.

The amount of the colorant is preferably 2 parts by mass to 15 parts by mass relative to 100 parts by mass of the binder resins. The colorant is preferably used in a form of the master batch in which the colorant is dispersed in the mixed binder resin of the first and second binder resins, in terms of dispersibility.

The amount of the master batch to be added may be any as long as the amount of the colorant is in the above range. It is suitable that the amount of the colorant in the master batch is 20% by mass to 40% by mass.

—Charge Controlling Agent—

In the toner of the present invention, known charge controlling agents conventionally used for the full color toner may be used.

The charge controlling agent is not particularly limited and may be appropriately selected depending on the purpose; examples thereof include nigrosine dyes, triphenylmethane dyes, chromium-containing metal complex dyes, molybdic acid chelate pigments, rhodamine-based dyes, alkoxy-based amine, quaternary ammonium salts (including fluorine modified quaternary ammonium salts), alkylamide, a single body or compounds of phosphorus, a single body or compounds of tungsten, fluorine-based active agents, salicylate metal salts and metal salts of salicylic acid derivatives.

For the charge controlling agent, commercially available products may be used; examples of the commercially available products include Bontron 03 of the nigrosine dye, Bontron P-51 of the quaternary ammonium salt, Bontron S-34 of the metal-containing azo dye, E-82 of oxynaphthoic acid-based metal complex, E-84 of salicylic acid-based metal complexes, E-89 of phenol-based condensate (manufactured by Orient Chemical Industries Ltd.); TP-302 and TP-415 of a quaternary ammonium salt molybdenum complexes (manufactured by Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (manufactured by Hoechst); LRA-901, and LR-147 of a boron metal complex (manufactured by Japan Carlit Co., Ltd.); copper phthalocyanine, perylene, quinacridone, azo-based pigments, and polymer-based compounds having functional groups such as sulfonic acid group, carboxyl group and quaternary ammonium salt. Of these, substances which control the toner to negative polarity are preferably used.

The amount of the charge controlling agent to be used is determined depending on the type of the binder resin, the presence or absence of additives used as needed and the method for producing the toner including a dispersion method, and is not uniquely limited, but is preferably 0.1 parts by mass to 10 parts by mass and more preferably 0.2 parts by mass to 5 parts by mass relative to 100 parts by mass of the binder resin.

—External Additive—

The external additives that are used for aiding flowability, as well as development ability and electrostatic chargeability of the toner, is not particularly limited, can be appropriately selected from those known publicly depending on the purpose, and is, for example, preferably fine inorganic particles.

The primary particle diameters of the fine inorganic particles are preferably 5 nm to 2 μm, and more preferably 5 nm to 500 nm. The specific surface areas according to a BET method are preferably 20 $m^2/g$ to 500 $m^2/g$.

The amount of the fine inorganic particles added is preferably 0.01% by mass to 5% by mass, and more preferably 0.01% by mass to 2.0% by mass relative to the amount of the toner.

The fine inorganic particles are not particularly limited and can be appropriately selected depending on the purpose; examples thereof include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

Resin fine particles can be used as the external additive. Examples of the resin fine particles include polystyrenes obtained by soap-free emulsification polymerization, suspension polymerization, and distributed polymerization; copolymers of a methacrylic acid ester and an acrylic acid ester; polycondensation series such as silicone, benzoguanamine, and nylon; and polymer particles from thermosetting resins.

—Additional Components—

The additional components are not particularly limited, can be appropriately selected depending on the purpose, and include, for example, a flowability improver, a cleaning ability improver, and a metal soap.

The flowability improver increases hydrophobicity by a surface treatment, can prevent degradation of flow characteristics or charging characteristics even at a high humidity, and includes, for example, a silane coupling agent, a silylating agent, a silane coupling agent having a fluorinated alkyl group, an organic titanate-based coupling agent, an aluminum-based coupling agent, a silicone oil, a modified silicone oil, and so forth.

The cleaning ability improver is added to the toner for removing a residual developer after transfer left on a latent image bearing member and an intermediate transfer body, and includes for example, a fatty acid metal salt such as zinc stearate, calcium stearate, and stearic acid; fine polymer particles produced by soap free emulsification polymerization such as fine polymethylmethacrylate particles and fine polystyrene particles. The fine polymer particles preferably have relatively narrow particle size distribution and appropriately have a volume average particle diameter of 0.01 μm to 1 μm.

<Method for Producing Toner>

The method for producing the toner is not particularly limited and can be appropriately selected from known methods for producing a toner depending on the purpose; examples thereof include kneading/pulverization method, polymerization method, solution suspension method, and spray granulation method. Among these methods, kneading/pulverization method is particularly preferred.

—Kneading/Pulverization Method—

The kneading/pulverization method is, for example, a method of melt-kneading toner materials containing at least a binder resin, a releasing agent, and a colorant, and pulverizing and classifying the kneaded product thus obtained, to produce base particles of the toner.

In the melt-kneading, the toner materials are mixed, and the mixture is put into a melting kneader to be melt-kneaded. The melting kneader may be one-shaft or two-shaft continuous kneaders or batch kneaders with roll mills. Preferable examples thereof include KTK type two-shaft extruder (by Kobe Steel, Ltd.), TEM type extruder (by Toshiba Machine Co.), two-shaft extruder (by KCK Co.), PCM type two-shaft extruder (by Ikegai Ltd.), and Co-kneader (by Buss Co.). It is important that the melt-kneading step is carried out under appropriate conditions in which molecular chains of binder resins are not cut. Specifically, the melt-kneading temperature is adjusted considering the softening point of the binder resin. When the temperature is excessively higher than the softening point, molecular chains of binder resins are severely cut. When the temperature is excessively low, toner materials may not be sufficiently dispersed.

In the pulverizing, the kneaded product obtained from the kneading step is pulverized. In the pulverizing, preferably the kneaded product is roughly pulverized then finely pulverized. Examples of preferred pulverizing methods include a method of making the materials collide with a plate by means of jet air, a method of making particles collide each other by means of jet air, and a method of pulverizing by use of a narrow gap between mechanically rotating rotors and stators.

In the classifying, the pulverized product obtained from the pulverizing is classified so as to obtain particles of a predetermined particle diameter. The classifying may be carried out by removing a part of the particles that are finer than a desired size by, for example, a cyclone, a decanter, or a centrifuge.

After the pulverizing and classifying, the pulverized product is classified in an air flow by use of centrifugal force, thereby to produce toner base particles having a predetermined particle diameter.

Next, an external additive is added externally to the toner base particle. While being broken and pulverized, the external additives are applied to a surface of the toner base particles by mixing and stirring the toner base particles and the external additives using a mixer. In this process, it is important to attach uniformly and tightly the external additives such as fine inorganic particles and fine resin particles to the toner base particles, in terms of good durability.

The toner thus obtained preferably has a volume average particle diameter of 6 μm to 10 μm. When the volume average particle diameter of the toner is 6 μm or more, the adherence force of the toner becomes small, resulting in less occurrence of filming on the developing roller. The volume average particle diameter of the toner is preferably 10 μm or less in terms of high image quality.

The volume average particle diameter may be measured using, for example, a particle size measurement device MULTISIZER II (manufactured by Beckman Coulter, Inc.).

The toner preferably has a softening point (Tm) of 110° C. to 140° C. When the softening point of the toner is 110° C. or more, toner adhesion due to heat generation at the toner layer thickness regulating unit becomes less likely to occur. When the softening point of the toner is 140° C. or less, the toner becomes easy to melt at the time of fixing, resulting in less occurrence of low-temperature offset.

—Transfer Step and Transfer Unit—

The transfer step is a step of transferring the visible image to a recording medium, and it preferably uses an intermediate transfer member so that the visible image is transferred primarily on the intermediate transfer member and then the visible image is transferred secondarily to the recording medium. More preferably, the transfer step consists of a first transfer step in which a visible image, formed using toner of two or more colors or preferably full-color toner, is transferred to the intermediate transfer member to form a complex image thereon, and a secondary transfer step in which the complex image is transferred to a recording medium.

The transfer step can be performed by charging the latent image bearing member (photoconductor) by means of a transfer charging device, which is achieved by the transfer unit. A preferred embodiment of the transfer unit is that it includes a primary transfer unit in which a visible image is transferred to the intermediate transfer member to form a complex transfer image thereon, and a secondary transfer unit in which the complex transfer image is transferred to a recording medium.

The intermediate transfer member is not particularly limited and can be appropriately selected from known transfer members depending on the intended purpose; preferred examples include a transfer belt.

The transfer unit (the primary transfer unit and secondary transfer unit) preferably includes at least a transfer device configured to transfer the visible image formed on the latent image bearing member (photoconductor) to the recording medium by means of electrical charge. There may be only one transfer unit or may be two or more transfer units.

Examples of the transfer device include a corona transfer device utilizing corona discharge, a transfer belt, a transfer roller, a pressure-transfer roller, and an adhesion-transfer device.

The recording medium is not particularly limited and can be appropriately selected from known recording media (recording paper sheets).

The fixing step is a step of fixing the visible image transferred on a recording medium using a fixing unit. The fixing step may be performed for each of the toner images having different colors when they are transferred to the recording medium, or may be performed at a time for laminated toner images.

The fixing device is not particularly limited and can be appropriately selected depending on the intended purpose, with a preferred example being a known heating and pressurizing unit. The heating and pressurizing unit is, for example, a combination of a heating roller and a pressurizing roller, a combination of a heating roller, a pressurizing roller and an endless belt.

The fixing device is preferably a unit composed of at least a heated body having a heat generator, film in contact with the heated body, and a pressurizing member pressurizing the heated body in indirect contact with the member over the film, configured to heat and fix the visible image by feeding a recording medium with an unfixed image formed thereon between the film and the pressurizing member. In general, the heating temperature of the heating and pressurizing unit is preferably 80° C. to 200° C.

In the present invention, for example, a known photo-fixing device can be used along with or in place of the fixing step and fixing unit depending on the intended purpose.

The charge eliminating step is a step of applying a charge-eliminating bias to the latent image bearing member for charge removal. This is suitably performed by the charge eliminating unit.

The charge eliminating unit is not particularly limited as long as a charge eliminating bias can be applied to the latent image bearing member for charge removal, and can be appropriately selected from known charge eliminating devices. A suitable example thereof is a charge eliminating lamp.

The cleaning step is a step of removing residual toner on the latent image bearing member. This is suitably performed by means of the cleaning unit.

The cleaning unit is not particularly limited as long as such residual electrophotographic toner on the latent image bearing member can be removed, and can be appropriately selected from known cleaners; preferred examples thereof include a magnetic brush cleaner, an electrostatic brush cleaner, a magnetic roller cleaner, a blade cleaner, a brush cleaner, and a wave cleaner.

The recycling step is a step of recycling toner collected in the cleaning step to the developing unit. This is suitably performed by means of the recycling unit.

The recycling unit is not particularly limited and may be, for example, known conveyance units.

The controlling step is a step of controlling each of the aforementioned steps. This is suitably performed by means of the control unit.

The control unit is not particularly limited as long as it is capable of controlling the operation of each of the aforementioned units, and can be appropriately selected depending on the intended purpose; examples thereof include such devices as sequencers and computers.

FIG. 1 is a sectional view showing an example of a developing unit and a process cartridge unit used in the image forming apparatus of the present invention.

The developing unit contains a toner container 101 for containing the toner, a toner supply chamber 102 disposed under the toner container 101. Under the toner supply chamber 102, a developing roller 103 having a diameter of 12 mm or less, and a toner layer thickness regulating unit 104 and a supply roller 105 having a diameter of 12 mm or less, both of which contact the developing roller 103 are disposed. In FIG. 1, 30, 50, and 70 represent a charging unit, a cleaning unit, and a transfer unit, respectively.

The developing roller 103 is disposed contacting a photoconductor drum 20 and is applied with a predetermined developing bias by a high-voltage power supply (not shown). In the toner container 101, a toner mixing unit 106 is equipped and configured to rotate in the counterclockwise direction. In an axial direction, a part of an edge of the toner mixing unit 106, which does not pass near an opening, has a larger surface area for feeding the toner by rotation drive so as to sufficiently fluidize and mix the contained toner, while a part of the edge of the toner mixing unit 106, which passes near the opening, has a smaller surface area for feeding the toner by rotation drive so as not to introduce an excess amount of the toner to the opening 107. The toner near the opening 107 is appropriately loosen by means of the toner mixing unit 106, passes through the opening 107 and drops to the toner supply chamber 102 by its own weight. By coating the surface of the supply roller 105 with a foamed material having pores (foamed cells) of a size of 300 μm to 500 μm, the toner fed into the toner supply chamber 102 is effectively attached and incorporated thereto, and the toner degradation by pressure concentration at a contact portion with the developing roller 103 is prevented. The electric resistance value of the foamed material is set at $10^3\Omega$ to $10^{14}\Omega$.

A supply bias of the value which is offset in the same direction as the charged polarity of the toner corresponding to developing bias is applied to the supply roller 105. The supply bias affects, at the contact portion with the developing roller 103, in the direction of pressing the precharged toner to the developing roller 103. However, the offset direction is not limited thereto, offset may be 0, or the offset direction may be changed depending on the types of the toner. The supply roller 105 rotates in the counterclockwise direction so as to supply and apply the toner adhered on the surface thereof to the surface of the developing roller 103. The surface roughness (Ra) of the developing roller 103 is set in the range of 1.1 μm to 1.8 μm so that the required amount of the toner can be retained on the surface thereof. The developing roller 103 rotates in a counterclockwise direction and conveys the toner retained on the surface thereof to positions facing the toner layer thickness regulating unit 104 and the photoconductor drum 20.

A free end of the toner layer thickness regulating unit 104 is brought into contact with the surface of the developing roller 103 at a suppress strength of 10 N/m to 100 N/m. The toner passed through the suppressed spot of the toner layer thickness regulating unit is made in a form of thin layer and is charged by frictional charging, simultaneously. Moreover, a control bias of the value which is offset in the same direction as the charged polarity of the toner corresponding to a developing bias may be applied to the toner layer thickness regulating unit 104 to assist frictional charging.

The photoconductor drum 20 rotates in a clockwise direction, therefore, the surface of the developing roller 103 moves in the same direction as the moving direction of the photoconductor drum 20 at the facing position with the photoconductor drum 20. The toner formed in the thin layer is fed to the facing position between the developing roller 103 and the photoconductor drum 20 by the rotation of the developing roller 103, and is moved to the surface of the photoconductor drum 20 and developed according to the latent image electric field formed by the developing bias applied to the developing roller 103 and a latent electrostatic image on the photoconductor drum 20. A seal 108 is provided contacting the developing roller 103 at the part where the toner, which has not been spent for development on the photoconductor drum 20 and remains on the developing roller 103, returns to the toner supply chamber 102 so as to seal the developing unit, and thereby prevents the toner form leaking out thereof.

According to the image forming apparatus and the image forming method of the present invention, both excellent fixing property and excellent adhesion resistance can be satisfied and high-quality images can be formed, even when using a developing roller and a supply roller each having a diameter as small as 12 mm or less.

EXAMPLES

Hereinafter, Examples of the present invention are described, however, these Examples should not be construed as limiting the scope of the invention.

Synthesis Example 1

—Preparation of First Binder Resin—

As vinyl based monomers, 600 g of styrene, 110 g of butyl acrylate, and 30 g of acrylic acid and 30 g of dicumyl peroxide as a polymerization initiator were placed in a dropping funnel. In a 5 liter four-necked flask equipped with a thermometer, a stainless stirrer, a falling type condenser and a nitrogen introducing tube, 1230 g of polyoxypropylene(2.2)-2,2-bis(4-hydroxyphenyl)propane, 290 g of polyoxyethylene(2.2)-2,2-bis(4-hydroxyphenyl)propane as polyols among monomers of polyester, 250 g of isododecenyl succinic acid anhydrate, 310 g of terephthalic acid, 180 g of 1,2,4-benzene tricarboxylic acid anhydrate, and 7 g of dibutyl tin oxide as an esterification catalyst were placed, and subsequently, under a nitrogen atmosphere in a mantle heater, with stirring at a temperature of 160° C., the mixture of the vinyl-based monomer resin and the polymerization initiator was dripped from the above dropping funnel over one hour. Then, with keeping at 160° C., an addition polymerization reaction was matured for 2 hours, and subsequently the temperature was raised to 230° C. and a polycondensation reaction was performed. The polymerization degree was traced using the softening point measured using a constant load extrusion capillary rheometer, and when the desired softening point was reached, the reaction was terminated. In this way, a resin H1, H2, or H3 with a softening point (Tm) of 115° C., 138° C., and 159° C., respectively was synthesized.

Synthesis Example 2

—Preparation of Second Binder Resin—

In a 5 liter four-necked flask equipped with a thermometer, a stainless stirrer, a falling type condenser, and a nitrogen introducing tube, 2210 g of polyoxypropylene(2.2)-2,2-bis (4-hydroxyphenyl)propane as polyol, 850 g of terephthalic acid, 120 g of 1,2,4-benzene tricarboxylic acid anhydrate and 0.5 g of dibutyl tin oxide as an esterification catalyst were placed. Then, under the nitrogen atmosphere in the mantle heater, the temperature was raised to 230° C. and the polycondensation reaction was performed. The polymerization degree was traced using the softening point measured using the constant load extrusion capillary rheometer, and when the desired softening point was reached, the reaction was terminated to obtain a second binder resin. In this way, resin L1 having a softening point (Tm) of 100° C. was synthesized.

Production Examples 1 to 10 and Comparative Production Examples 1 to 5

—Preparation of Toner—

A master batch containing 4 parts by mass of C.I. Pigment Red 57:1 relative to 100 parts by mass of the binder resin consisting of the first binder resin and the second binder resin (a mass ratio of the first binder resin to the second binder resin is 50:50; and the types thereof are indicated in Table 1), a paraffin wax at a amount indicated in Table 1, and one part by mass of a boron-based charge controlling agent was sufficiently mixed using a Henschel mixer, and subsequently melt-kneaded using a biaxial extrusion kneader (PCM-30, manufactured by Ikegai Tekkosho). The resulting kneaded product was pressed and extended to a thickness of 2 mm using a cooled press roller, cooled with a cooling belt, and subsequently roughly pulverized using a feather mill. Subsequently, the roughly-pulverized product was pulverized using a mechanical pulverizer (KTM, manufactured by Kawasaki Heavy Industries, Ltd.) to have an average particle diameter of 10 μm to 12 μm, and further pulverized using a jet pulverizer (IDS, manufactured by Nippon Pneumatic MFG. Co., Ltd.) with roughly classifying, and subsequently subjected to fine particle classification using a rotor type classifying machine (deep lex type classifying machine 100ATP, manufactured by Hosokawa Micron Ltd.) to prepare toner base particles of Production Examples 1 to 10 and Comparative Production Examples 1 to 5.

The amount of exposed wax on a surface can be adjusted by controlling mixing conditions of a Henschel mixer before melt-kneading and kneading conditions, in preparation process of each toner base particle. For example, the particle diameter of the wax may be reduced by enhancing mixing by a Henschel mixer, thereby reducing the amount of exposed wax on a surface. Furthermore, the amount of exposed wax on a surface can be adjusted by a treatment temperature and a pressure at which the melt-kneading is performed. For example, the amount of exposed wax on a surface can be reduced by kneading at a lower temperature which increases a shearing force to resins to reduce the wax particle diameter.

Then, 3.0 parts by mass of a fine inorganic particle (CAB-O-SIL TS530, manufactured by Cabot Corporation) was added to 100 parts by mass of the toner base particle thus obtained, and the mixture was mixed by a Henschel mixer to prepare each magenta toner.

Properties of each magenta toner thus obtained were measured as follows. The results are shown in Table 1.

<Melting Point of Wax>

The melting point of wax was measured as follows using a differential scanning calorimeter (DSC-200, manufactured by Seiko Electronic Industry Co., Ltd.). Precisely measured into an aluminum pan of the differential scanning calorimeter 5 mg of each toner, the toner was heated from a normal temperature to 200° C. at a temperature raising rate of 30° C./min, and then cooled. Next, the toner was subjected to measurement by the differential scanning calorimeter which scans from 20° C. to 120° C. at a temperature raising rate of 10° C./min. A main endothermic peak temperature of the toner measured in a temperature raising process from 30° C. to 90° C. was taken as the melting point of the wax. As a reference for the measurement, aluminum placed in the aluminum pan was used.

<Amount of Exposed Wax on Surface>

The amount of exposed wax on a surface of the toner was determined by measuring off 1.0 g of each toner base particle before addition of the fine inorganic particle, adding 7 ml of n-hexane thereto, stirring the mixture for one min by a roll mill at 120 rpm, subjecting the solution to suction filtration, removing n-hexane by vacuum drying, and quantifying the mass (mg) of the components remained which corresponds to the amount of exposed wax on a surface of the toner.

<Torque Evaluation by Method Using Conical Rotor>

Figure 2:
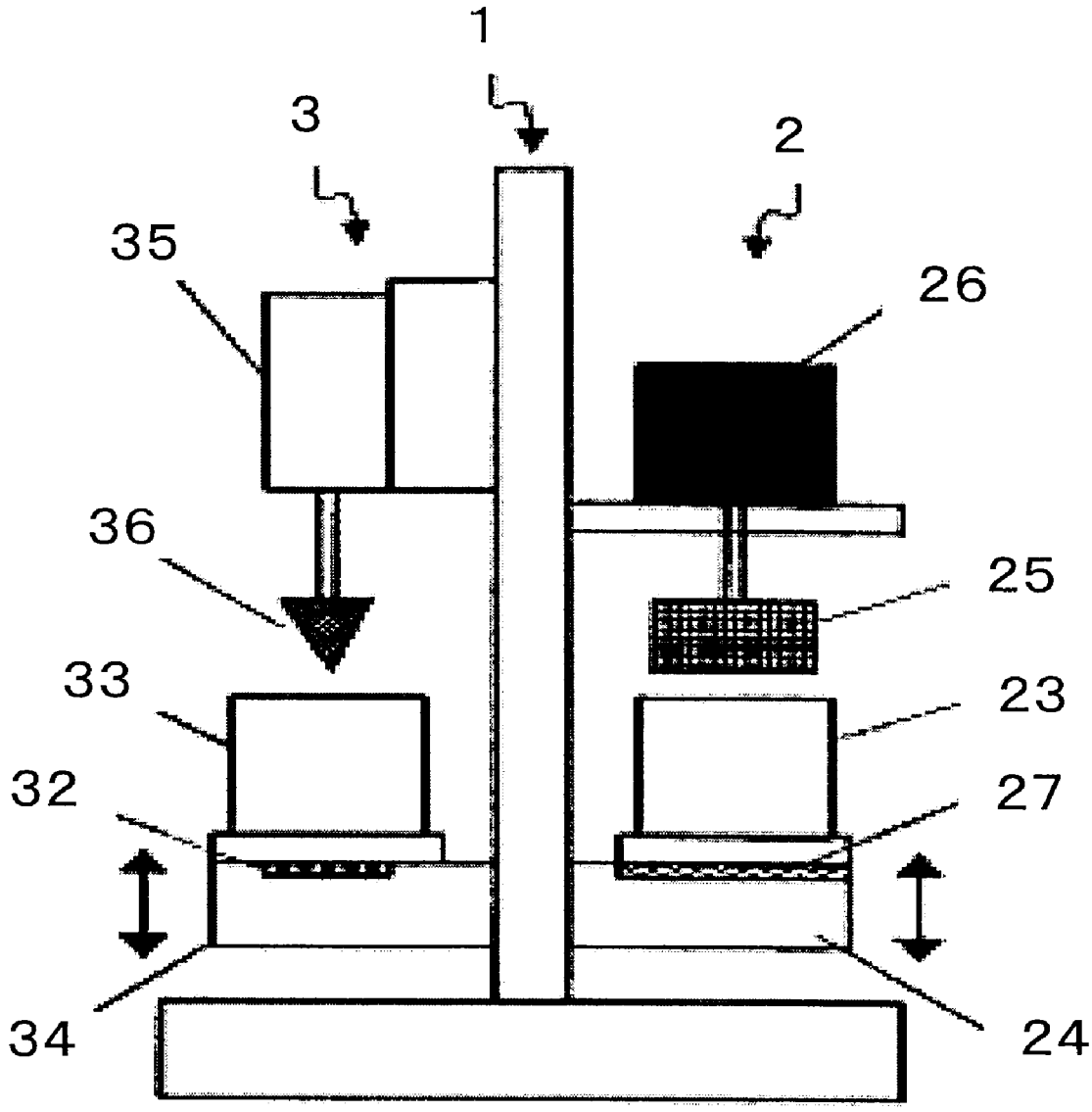
FIG. 2 is a view showing an apparatus employed for torque measurement using a conical rotor.

A measurement device 1 shown in FIG. 2 is composed of a consolidation zone 2 and a measurement zone 3. The consolidation zone 2 consists of at least a sample container 23 configured to contain each toner, an elevating stage 24 configured to move up and down the sample container, a piston 25 configured to consolidate the toner, and a weight 26 configured to load the piston 25. However this configuration is one example and may not be construed as limiting the scope of configurations of a measurement device of the present invention. In this configuration, the sample container 23 containing each toner is moved up to come into contact with the piston 25 for consolidating the toner, and is further moved up to make the weight 26 load the piston 25 with a load equivalent to the weight of the weight 26, and the weight 26 is made lifted off a support plate to be left in this state for a given period of time. Subsequently, the piston 25 is detached from the surface of the toner sample by moving down the elevating stage 24 on which the sample container 23 containing each toner sample is placed. The piston 25 may be of any material as long as the surface of the piston for pressing the toner is smooth in respect to surface property. Therefore, the material of the piston is preferably material which is easy to be processed, has hard surface, and is resistant to deterioration. In addition, since it is necessary to avoid adhesion of the toner to the piston due to charging, for the material of the piston preferably a conductive material is used. An example of the conductive material includes SUS, Al, Cu, Au, Ag, and brass; in this Example brass was used.

The measurement zone 3 consists of at least a sample container 33 configured to contain a toner, an elevating stage 34 configured to move up and down the sample container, a load cell 32 configured to measure the compression load, and a torque meter 35 configured to measure the torque of the toner. However this configuration is one example and may not be construed as limiting the scope of configurations of the measurement device of the present invention. A conical rotor 36 is installed at the tip of a shaft, and the position of the shaft is fixed (with respect to movement in the vertical direction). The elevating stage 34 with the toner-containing sample container 33 placed at the central area of the stage can be moved up and down so that the conical rotor 36, while being rotated, is intruded into the sample container 33 at the center by moving up the sample container 33. The torque exerted on the conical rotor 36 is detected by the torque meter 35 disposed above the conical rotor; and the compression load exerted on the toner-containing sample container 33 is detected by the load cell 32 placed under the sample container 33. The movement distance of the conical rotor 36 is detected by a position detector (not shown). This configuration is one example, and other configuration such as a configuration in which the shaft is moved up and down may also be used.

The consolidation state of the toner phase may be evaluated from information on the height and the mass of the powder phase by measuring the mass of the toner using the load cell 32 placed under the sample container 33. The calculation based on this information is performed using an electronic computer (not shown).

Figure 3A:
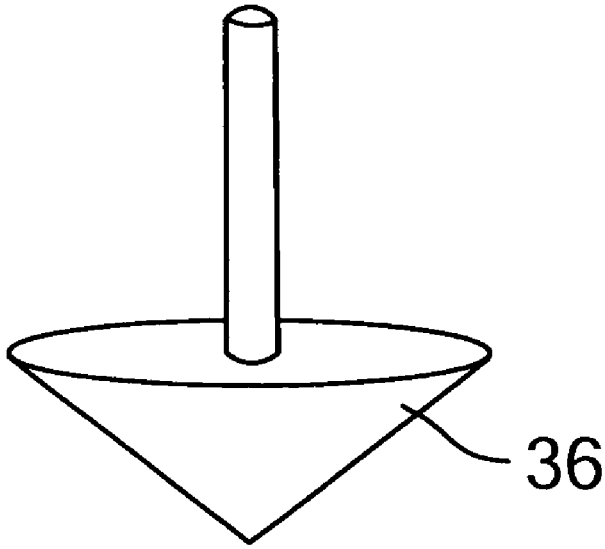
FIG. 3A is a view showing an example of a conical rotor.
Figure 3B:
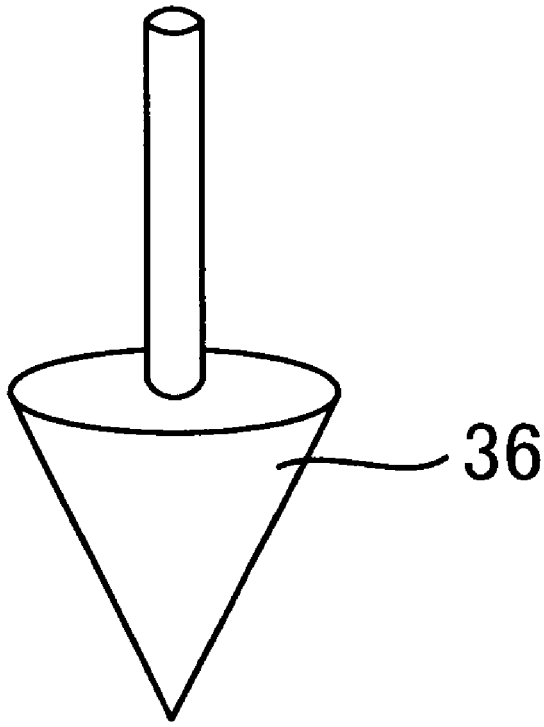
FIG. 3B is a view showing another example of a conical rotor.

The conical rotor 36 preferably has an apex angle of 20° (see FIG. 3B) to 150° (see FIG. 3A). The length of the conical rotor 36 needs to be so long that the cone-shaped rotor part can be sufficiently embedded inside the powder phase.

The material of the sample container 33 is not particularly limited and is preferably conductive material so that charging of the sample container due to the toner may not adversely affect the torque evaluation. Since in the measurement the sample container 33 is repeatedly used with the toner sample replaced for a different toner sample each time, the sample container 33 preferably has a near mirror surface for reducing smearing. It is important to appropriately select the size of the sample container 33; the size (diameter) of the sample container 33 needs to be so large relative to the diameter of the conical rotor 36 that existence of the wall of the sample container 33 may not adversely affect the torque measurement when the conical rotor 36, while being rotated, is intruded into the toner sample.

Figure 4:
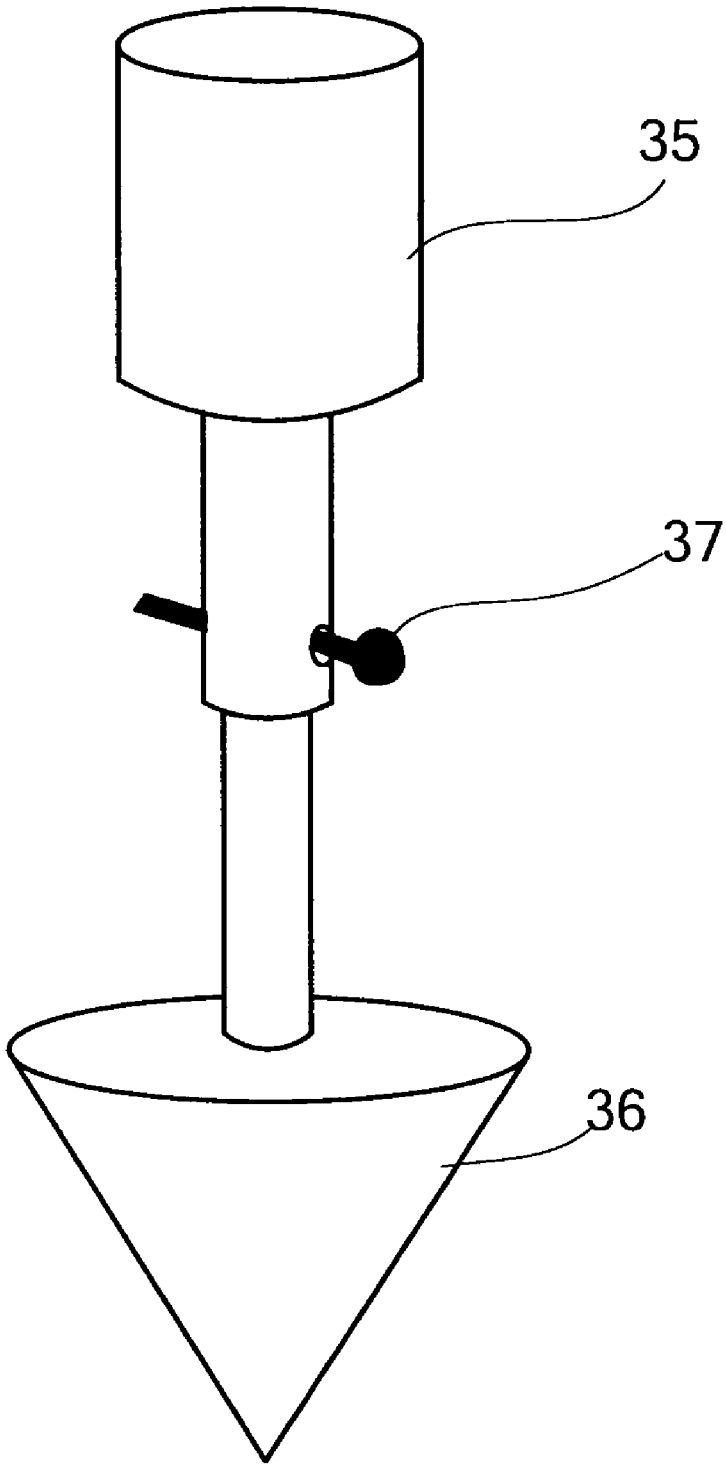
FIG. 4 is a view showing a configuration in which a conical rotor is fixed on a torque meter.

The conical rotor 36 is installed on the torque meter 35 using a mounting screw 37 as shown in FIG. 4 so that different conical rotors 36 with various materials can be easily mounted on and detached from the torque meter. Since the conical rotor 36 can be mounted on and detached from the torque meter by using only one mounting screw, the conical rotors 36 made of different materials can be easily mounted by turns and flowability of the toner can be evaluated under different measurement conditions of material for the conical rotor.

The torque meter 35 is preferably a highly-sensitive type, and may be a torque meter employing a non-contact process. The load cell 32 is preferably a load cell having a wide load range and a high resolution. Examples of the position detector include a linear scale and a displacement sensor using light; the position detector preferably has a specified precision of 0.1 mm or less. The elevating device is preferably an elevating device which can be precisely driven using a servomotor or a stepping motor.

The measurement is carried out as follows. A certain amount of a toner is put into the sample container 23 which is then placed on the measurement device. Subsequently, the toner phase is consolidated by pressing the powder surface using the piston with a given load, the pressing caused by moving up the elevating stage 24 in the consolidation zone 2. After the toner phase has been consolidated for a given period of time, the sample container 23 is moved down to return to the original position.

Subsequently, the sample container 23 containing the toner whose consolidation state has been measured is placed on the elevating stage 34 in the measurement zone 3 as the sample container 33. The sample container may be moved from the consolidation zone 2 to the measurement zone 3 by pivoting the elevating stage 34.

Subsequently, the conical rotor 36, while being rotated, is intruded into the toner phase in the sample container 33. The torque or the load is measured at a predetermined revolution and intrusion speed of the conical rotor. The revolution direction of the conical rotor 36 is arbitrarily selected. When the intrusion distance of the conical rotor 36 is short, values of the torque and the load becomes small to cause a problem of poor data reproducibility, etc. Therefore, the conical rotor is preferably intruded deep enough into the toner to avoid the problem of poor data reproducibility. In this Example, the poor data reproducibility in the measurement may be virtually eliminated when the intrusion distance of the conical rotor is 5 mm or more.

The measurement was carried out in a measurement mode described below.

(1) The sample container 23 was filled with each toner.

(2) The toner phase was consolidated by the piston 25.

(3) The conical rotor 36, while being rotated, was intruded into the container, and the torque (see Table 1) and the load at the time of the intrusion were measured.

(4) The intrusion was stopped when the conical rotor 36 reached a depth of a predetermined distance from the toner surface.

(5) Pulling out operation of the conical rotor 36 from the sample container was started.

(6) When the tip of the conical rotor 36 was detached from the surface of the toner phase and returned to the initial home position relative to the sample container, the pulling out operation and the rotation of the conical rotor 36 were stopped.

In measurement of the torque of a toner, the above operation consisting of steps (1) to (6) was repeated. The measurement might be carried out continuously.

The degree of consolidation of a toner sample may be evaluated by the void rate thereof. In this measurement method, the void rate of the toner phase is important. The measurement with stable results is only possible when the void rate is 0.4 or more. When the void rate is less than 0.4, a slight difference in degree of consolidation among samples adversely affects values of the torque and the load, causing difficulty in accomplishing the measurement with stable results. The range of the void rate of toner phases suitable for measurement methods of the torque and the load, including various other measurement methods, is 0.4 to 0.7. When the void rate is more than 0.7, the toner sample flies apart, thus toner samples having the range of the void rate of more than 0.7 are not suitable for measurement.

In this Example, toner samples each having a different void rate were prepared while varying a load of the weight 26, and a torque at a void rate of 58% was calculated based on a linear regression line established between the torque as the dependent variable and the void rate as the independent variable.

<Volume Average Particle Diameter of Toner>

As a measurement device for toner particle size distribution by a Coulter counter method, COULTER MULTISIZER II (manufactured by Coulter Company Limited) was used.

First, to 100 ml to 150 ml of an aqueous electrolyte solution, 0.1 ml to 5 ml of a surfactant (an alkylbenzene sulfonate salt) was added as a dispersant. Here, as the aqueous electrolyte solution, an aqueous solution of 1% by mass of NaCl using first-grade sodium chloride may be employed, and in this Example ISOTON-II (manufactured by Coulter Company Limited) was used. Subsequently, the sample for measurement (2 mg to 20 mg as solid content) is added. The electrolyte solution in which the sample is suspended is subjected to dispersion treatment for 1 min to 3 min by an ultrasonic dispersion device. Volumes and numbers of the toner are determined by the measurement device using a 100 μm aperture as an aperture, and volume distribution and number distribution are calculated. Based on the distributions thus produced, the volume average particle diameter (Dv) of the toner was calculated.

As channels, 13 channels were used, that is, channels of sizes of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm; and thus particles of diameter of 2.00 μm to less than 40.30 μm were covered for the measurement.

<Measurement of Softening Point (Tm) of Toner>

Using a FLOWTESTER CFT-500 (manufactured by Shimadzu Corporation), the measurement sample (1.5 g) was weighed and measured under the conditions of temperature increase rate of 3.0° C./min, preheating time of 180 sec, a load of 30 kg and a temperature range for measurement of 80° C. to 140° C., using a die of 1.0 mm in diameter and 1.0 mm in height, and a temperature at which a half of the above sample was eluted off was regarded as the softening point (Tm) of each toner.

TABLE 1

| | Binder resin | | Amount of wax (parts by | Melting point of wax | Amount of wax exposed on surface | Tm (° C.) of | Volume average particle diameter (μm) of | Torque T |
|---|---|---|---|---|---|---|---|---|
| | First | Second | mass) | (° C.) | (mg/g) | toner | toner | (mNm) |
| Prod. Ex. 1 | H2 | L1 | 2.7 | 73.2 | 20.1 | 128.6 | 8.6 | 2.79 |
| Prod. Ex. 2 | H2 | L1 | 5.5 | 72.1 | 24.5 | 114.2 | 6.4 | 1.87 |
| Prod. Ex. 3 | H2 | L1 | 2.7 | 73.2 | 20.1 | 128.6 | 8.6 | 2.79 |
| Prod. Ex. 4 | H2 | L1 | 3.4 | 71.3 | 14.3 | 131.4 | 9.3 | 2.40 |
| Prod. Ex. 5 | H2 | L1 | 3.4 | 71.3 | 14.3 | 131.4 | 9.3 | 2.40 |
| Prod. Ex. 6 | H2 | L1 | 3.5 | 74.5 | 17.9 | 135.6 | 9.1 | 3.24 |
| Prod. Ex. 7 | H2 | L1 | 6.1 | 73.2 | 28.9 | 126.7 | 9.0 | 3.03 |
| Prod. Ex. 8 | H2 | L1 | 2.3 | 74.2 | 12.5 | 126.9 | 8.8 | 2.78 |
| Prod. Ex. 9 | H3 | L1 | 3.4 | 70.5 | 18.8 | 141.3 | 8.5 | 2.11 |
| Prod. Ex. 10 | H1 | L1 | 3.4 | 72.5 | 17.3 | 108.4 | 8.9 | 2.63 |
| Comp. Prod. Ex. 1 | H2 | L1 | 3.4 | 75.7 | 16.5 | 118.6 | 9.5 | 2.54 |
| Comp. Prod. Ex. 2 | H2 | L1 | 2.7 | 71.9 | 31.5 | 120.7 | 7.5 | 2.01 |
| Comp. Prod. Ex. 3 | H2 | L1 | 3.4 | 70.5 | 9.8 | 132.9 | 8.4 | 2.26 |
| Comp. Prod. Ex. 4 | H2 | L1 | 2.7 | 72.4 | 11.2 | 128.4 | 9.2 | 2.80 |
| Comp. Prod. Ex. 5 | H2 | L1 | 5.5 | 69.8 | 27.9 | 133.3 | 9.0 | 2.31 |

Production Examples 11 to 23

—Preparation of Developing Roller—

A roller formed of an elastic base layer having a thickness of 3 mm was formed in accordance with the following procedure. A liquid conductive silicon rubber as an elastic base layer was injected into a cylindrical metal mold having an inner diameter of 8 mm in which a columnar metal core having an outer diameter of 5 mm had been placed so as to share the same center of a circular plane as the cylindrical metal mold. Then, the liquid conductive silicon rubber was heated and cast using an oven at 130° C. for 20 min. The resulting product was removed from the cylindrical metal mold with the columnar metal core, and subjected to secondary vulcanization using an oven at 200° C. for 4 hr.

Next, a coating material was prepared in accordance with the following procedure. A urethane coating material (polyether polyurethane) was diluted with methyl ethyl ketone so that the solid content of the dilution was 10% by mass. To the resulting dilution 30 parts by mass of a carbon black as a conductive material to 100 parts by mass of the solid content was added. The resulting mixture was fully dispersed. To the resulting dispersion 10 parts by mass of a curing agent (aromatic diisocyanate) to 100 parts by mass of the solid content of the urethane coating material was added. The resulting coating material was stirred. An intermediate layer was formed on the roller formed of an elastic base layer prepared previously in accordance with the following procedure. The resulting coating material was applied onto the roller by dipping so that the resulting layer of the coating material had a thickness of 10 μm. The roller coated with the resulting coating material was dried using an oven at 80° C. for 15 min. The resulting layer was cured using an oven at 140° C. for 4 hr.

Further, another coating material was prepared in accordance with the following procedure. A urethane coating material (polyether polyurethane) was blended with an acrylic coating material in a mass ratio of the urethane coating material to the acrylic coating material of 95:5. The blend of coating materials was diluted with methyl ethyl ketone so that the solid content of the dilution was 10% by mass. To the resulting dilution 40 parts by mass of a carbon black as a conductive material to 100 parts by mass of the solid content and 5 parts by mass of an acrylic bead (average particle diameter: 15 μm) as a surface roughening material to 100 parts by mass of the solid content were added. The resulting mixture was fully dispersed. To the resulting dispersion 10 parts by mass of a curing agent (aromatic diisocyanate) to 100 parts by mass of the solid content of the urethane coating material was added. The resulting coating material was stirred. A surface layer having a surface roughness Ra of 1.14 μm was formed on the intermediate layer of the roller in accordance with the following procedure. The resulting another coating material was applied onto the intermediate layer by dipping so that the resulting layer of the another coating material had a thickness of 10 μm. The resulting roller was dried using an oven at 80° C. for 15 min. The resulting layer on the intermediate layer was cured using an oven at 140° C. for 4 hr. A developing roller of Production Example 11 was thus prepared.

In addition, the developing rollers having roller diameters shown in Table 2 were prepared by varying addition amounts of the acrylic bead as shown in Table 2 to adjust the surface roughness Ra of the developing rollers as indicated in Table 2.

—Preparation of Supply Roller—

A supply roller of Production Example 11 was prepared in accordance with the following procedure. A polyurethane foam was prepared by slab foaming using materials containing 100 g of polyether polyol and 30 g of aromatic polyisocyanate. The polyurethane foam was cut out so as to prepare a cylindrical polyurethane foam having an inner diameter of 4 mm. A columnar metal core having an outer diameter of 4 mm was inserted and bonded to the cylindrical polyurethane foam.

The supply rollers having roller diameters shown in Table 2 were prepared by varying viscosity of the polyols as shown in Table 2 to adjust the cell diameters of the supply rollers as indicated in Table 2.

For each of the developing rollers and the supply rollers thus obtained, the surface roughness of a developing roller and the cell diameter of a supply roller were measured in the manners described below. The results are shown in Table 2

<Surface Roughness (Ra) of Developing Roller>

The surface roughness (Ra) of a developing roller was measured for a length of 25 mm in an axial direction of the developing roller, using a contact-type surface roughness meter (SURFCOM 1400, manufactured by TOKYO SEIMITSU CO., LTD.).

<Cell Diameter of Supply Roller>

Hundred of cells of a supply roller were randomly observed by an optical microscope (CX31-P, manufactured by OLYMPUS CORPORATION) to approximate cell diameter each corresponding to a circle diameter by means of image processing, and the average value was recognized as a cell diameter of the supply roller.

TABLE 2

| | Amount of acrylic bead added (parts by mass) | Viscosity of polyols (mPa/sec) | Diameter R (mm) of developing roller | Ra (μm) of developing roller | Diameter R' (mm) of supply roller | Cell diameter (μm) of supply roller |
|---|---|---|---|---|---|---|
| Prod. Ex. 11 | 5 | 890 | 8 | 1.14 | 8 | 350 |
| Prod. Ex. 12 | 10 | 890 | 12 | 1.73 | 8 | 350 |
| Prod. Ex. 13 | 13 | 1200 | 9 | 1.92 | 8 | 410 |
| Prod. Ex. 14 | 4 | 890 | 10 | 1.03 | 12 | 350 |
| Prod. Ex. 15 | 7 | 1700 | 10 | 1.51 | 12 | 540 |
| Prod. Ex. 16 | 8 | 700 | 8 | 1.58 | 12 | 270 |
| Prod. Ex. 17 | 8 | 890 | 8 | 1.58 | 10 | 350 |
| Prod. Ex. 18 | 6 | 1450 | 10 | 1.35 | 6 | 440 |
| Prod. Ex. 19 | 6 | 1450 | 10 | 1.35 | 10 | 440 |
| Prod. Ex. 20 | 7 | 1200 | 10 | 1.51 | 10 | 410 |
| Prod. Ex. 21 | 10 | 1200 | 12 | 1.73 | 6 | 410 |
| Prod. Ex. 22 | 7 | 890 | 10 | 1.51 | 10 | 350 |
| Prod. Ex. 23 | 8 | 890 | 8 | 1.58 | 12 | 350 |

Examples 1 to 10 and Comparative Examples 1 to 5

Next, using an image forming apparatus equipped with a developing device mounting a toner, a developing roller and a supply roller indicated in Table 3, adhesion resistance, fixing property, and image quality were evaluated as follows. The results are shown in Table 3.

<Evaluation of Adhesion Resistance>

A color laser printer (IPSIO CX2500, manufactured by Ricoh Company, Ltd.) was remodeled so as to be equipped with a developing device to which a developing roller and supply roller indicated in Table 3 were mounted. The color laser printer was charged with a toner indicated in Table 3. Then, using the remodeled color laser printer, an image having a print area ratio of 5% was printed on 5,000 sheets of paper, and then a solid image was printed. Occurrence or nonoccurrence of a streak in the printed solid image was visually observed to evaluate the adhesion resistance using the following criteria.

[Evaluation Criteria]

A: No streak was found, without causing problem

B: white streaks were found, however, without causing problem in quality

C: white streaks were found, causing a problem in quality

<Fixing Property>

Five parts by mass of a toner indicated in Table 3 was mixed with 95 parts by mass of a carrier coated with a silicone resin, and the mixture was stirred to prepare a two-component developer. An image forming apparatus (IPSIO CX7500, manufactured by Ricoh Company, Ltd.) was remodeled so as to be equipped with a developing device to which a developing roller and supply roller indicated in Table 3 were mounted and to remove a fixing unit. The remodeled image forming apparatus was charged with the two-component developer and was adjusted so that 1.1±0.1 mg/cm$^2$ of the toner was developed in a solid image having a margin of 3-mm width in the machine direction of the paper on a sheet of transfer paper (TYPE 6200Y paper (the longitudinal direction of the paper sheet corresponds to the cross direction of the paper), manufactured by Ricoh Company, Ltd.). Then, 6 sheets of transfer paper having the solid image thereon in an unfixed state were printed.

Subsequently, using a fixing test device which was manufactured from the fixing unit of a color laser printer (IPSIO CX2500, manufactured by Ricoh Company, Ltd.) and modified so that the temperature and the linear speed of a fixing belt can be controlled to desired values, the solid image on a sheet of the transfer paper in an unfixed state was fixed from the margin of a 3-mm width at a linear speed of the belt of 125 mm/sec and at 5 different fixing belt temperatures (each representing a temperature in each of 5 temperature ranges: 140° C. to less than 150° C., 150° C. to less than 160° C., 160° C. to less than 170° C., 170° C. to less than 180° C., and 180° C. to less than 190° C.). The number of transfer paper sheets which did not fail during the fixing step (examples of the failure include the transfer paper sheet's clinging to the fixing belt and the transfer paper sheet's being caught before the outlet of the fixing device to be in an accordion-folded state) was counted for evaluation of the fixing property using the following criteria.

[Evaluation Criteria]

A: The number of transfer paper sheets that did not fail at either of 5 different temperatures was 5 or more B: The number of the sheets was 2 to less than 5

C: The number of the sheets was less than 2

<Image Quality>

A color laser printer (IPSIO CX2500, manufactured by Ricoh Company, Ltd.) was remodeled so as to be equipped with a developing device to which a developing roller and supply roller indicated in Table 3 were mounted. The color laser printer was charged with a toner indicated in Table 3. Then, using the remodeled color laser printer, an image having a print area ratio of 5% was printed on 5,000 sheets of paper, and then blank, a half tone image, and a solid image were printed. The printed images and the developing members (such as toner layer thickness regulating unit and photoconductor) were evaluated by visual observation using the following criteria.

[Evaluation Criteria]

A: No problem was found in printed images and developing members.

B: A few problems were found in developing members, whereas no problem was found in printed images.

C: Some problems were found in printed images.

TABLE 3

| | Toner | Developing roller and supply roller | Evaluation | | |
|---|---|---|---|---|---|
| | | | Adhesion resistance | Fixing property | Image quality |
| Ex. 1 | Prod. Ex. 1 | Prod. Ex. 11 | A | A | A |
| Ex. 2 | Prod. Ex. 2 | Prod. Ex. 12 | A | A | A |
| Ex. 3 | Prod. Ex. 3 | Prod. Ex. 13 | A | A | B |
| Ex. 4 | Prod. Ex. 4 | Prod. Ex. 14 | B | A | A |
| Ex. 5 | Prod. Ex. 5 | Prod. Ex. 15 | A | A | B |
| Ex. 6 | Prod. Ex. 6 | Prod. Ex. 16 | B | A | A |
| Ex. 7 | Prod. Ex. 7 | Prod. Ex. 17 | B | A | A |
| Ex. 8 | Prod. Ex. 8 | Prod. Ex. 17 | A | B | A |
| Ex. 9 | Prod. Ex. 9 | Prod. Ex. 18 | A | B | A |
| Ex. 10 | Prod. Ex. 10 | Prod. Ex. 19 | B | A | A |
| Comp. Ex. 1 | Comp. Prod. Ex. 1 | Prod. Ex. 20 | A | C | A |
| Comp. Ex. 2 | Comp. Prod. Ex. 2 | Prod. Ex. 21 | C | A | A |
| Comp. Ex. 3 | Comp. Prod. Ex. 3 | Prod. Ex. 22 | A | C | A |
| Comp. Ex. 4 | Comp. Prod. Ex. 4 | Prod. Ex. 22 | A | A | C |
| Comp. Ex. 5 | Comp. Prod. Ex. 5 | Prod. Ex. 23 | C | A | A |

Since the image forming apparatus and the image forming method according to the present invention are capable of satisfying both excellent fixing property and excellent adhesion resistance and of forming high-quality images, even when using a developing roller and a supply roller each having a diameter as small as 12 mm or less, they may be widely used in printers and facsimiles employing various electrophotographic methods.

What is claimed is:

1. An image forming apparatus comprising:

a latent image bearing member, a latent electrostatic image forming unit configured to form a latent electrostatic image on the latent image bearing member, a developing unit which comprises a developing roller for supplying a toner to the latent electrostatic image and a supply roller for supplying the toner to the developing roller and is configured to develop the latent electrostatic image to form an visible image, and a transfer unit configured to transfer the visible image onto a recording medium, wherein both of a diameter R (mm) of the developing roller and a diameter R' (mm) of the supply roller are 12 mm or less, wherein the toner comprises a binder resin, a wax, and a colorant with the wax having a melting point of 75° C. or less; an amount of the wax exposed wax on a surface of the toner is 10 mg/g to 30 mg/g; and when a diameter (mm) of the developing roller is represented by R the toner has a torque T (mNm) satisfying the inequation, $20/R < T < 27/R$, at a void rate of 58% as measured by a torque measurement method using a conical rotor.

2. The image forming apparatus according to claim 1, wherein the developing roller has a surface roughness (Ra) of 1.1 μm to 1.8 μm.

3. The image forming apparatus according to claim 1, wherein the supply roller has foamed cells on the surface thereof and the cells have an average diameter of 300 μm to 500 μm.

4. The image forming apparatus according to claim 1, wherein the toner contains the wax in an amount of 2.5% by mass to 6.0% by mass.

5. The image forming apparatus according to claim 1, wherein the toner has a volume average particle diameter of 6 μm to 10 μm.

6. The image forming apparatus according to claim 1, wherein the toner has a softening point (Tm) of 110° C. to 140° C.

7. An image forming method comprising:

forming a latent electrostatic image on a latent image bearing member, developing the latent electrostatic image by means of a developing unit which comprises a developing roller for supplying a toner to the latent electrostatic image and a supply roller for supplying the toner to the developing roller, to form a visible image, and transferring the visible image onto a recording medium, wherein both of a diameter R (mm) of the developing roller and a diameter R' (mm) of the supply roller are 12 mm or less, wherein the toner comprises a binder resin, a wax, and a colorant with the wax having a melting point of 75° C. or less; an amount of the wax exposed on a surface of the toner is 10 mg/g to 30 mg/g; and when a diameter (mm) of the developing roller is represented by R the toner has a torque T (mNm) satisfying the inequation, $20/R < T < 27/R$, at a void rate of 58% as measured by a torque measurement method using a conical rotor.

8. The image forming method according to claim 7, wherein the developing roller has a surface roughness (Ra) of 1.1 μm to 1.8 μm.

9. The image forming method according to claim 7, wherein the supply roller has foamed cells on the surface thereof and the cells have an average diameter of 300 μm to 500 μm.

10. The image forming method according to claim 7, wherein the toner contains the wax in an amount of 2.5% by mass to 6.0% by mass.

11. The image forming method according to claim 7, wherein the toner has a volume average particle diameter of 6 μm to 10 μm.

12. The image forming method according to claim 7, wherein the toner has a softening point (Tm) of 110° C. to 140° C.

* * * * *